US007938691B2

(12) United States Patent
Wittmann

(10) Patent No.: US 7,938,691 B2
(45) Date of Patent: May 10, 2011

(54) CONTACT ELEMENT HAVING A SNAP-ON LANCE FOR A PLUG CONNECTOR

(75) Inventor: Rolf Wittmann, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/083,958

(22) PCT Filed: Sep. 12, 2006

(86) PCT No.: PCT/EP2006/066256
§ 371 (c)(1),
(2), (4) Date: Oct. 14, 2009

(87) PCT Pub. No.: WO2007/045530
PCT Pub. Date: Apr. 26, 2007

(65) Prior Publication Data

US 2010/0035467 A1 Feb. 11, 2010

(30) Foreign Application Priority Data

Oct. 21, 2005 (DE) ..... 10 2005 050 568

(51) Int. Cl.
*H01R 13/432* (2006.01)
*H01R 13/40* (2006.01)

(52) U.S. Cl. ..... 439/746; 439/595; 439/872

(58) Field of Classification Search ..... 439/746, 439/752, 872, 871, 870, 869, 595
See application file for complete search history.

(56) References Cited

U.S. PATENT DOCUMENTS

| | | | | |
|---|---|---|---|---|
| 4,239,321 | A * | 12/1980 | Bauer | 439/872 |
| 4,390,231 | A * | 6/1983 | Plyler et al. | 439/872 |
| 5,033,980 | A | 7/1991 | Watanabe et al. | 439/595 |
| 5,362,260 | A * | 11/1994 | Peloza | 439/746 |
| 6,368,165 | B2 * | 4/2002 | Kubo | 439/752 |

FOREIGN PATENT DOCUMENTS

| | | |
|---|---|---|
| DE | 36 00 456 | 7/1987 |
| DE | 199 33 211 | 1/2000 |
| EP | 0 208 185 | 1/1987 |
| EP | 1 215 763 | 6/2002 |
| GB | 832 970 | 4/1960 |

* cited by examiner

*Primary Examiner* — Hae Moon Hyeon
(74) *Attorney, Agent, or Firm* — Kenyon & Kenyon LLP

(57) ABSTRACT

Unipolar or multipolar electrical plug connectors include contact carriers having contact chambers, into which contact elements can be inserted. These contact elements latch with so-called snap-on lances. In the present SYSTEM, the latching is produced by a part of the contact element with a snap-on lance, a smooth outer geometry of the contact element being present in the assembled state, but by latching of a non-resilient snap-on lance within the contact chamber. Consequently, the advantages of the snap-on lance locking mechanism unite with those of the clean-body construction.

18 Claims, 3 Drawing Sheets

[A]
[B_I]
[C]
[B_II]
1
2
5
8
9
10
11
12
13
14
15
16
17
18
22
S
5_AB
B_II

CONTACT ELEMENT HAVING A SNAP-ON LANCE FOR A PLUG CONNECTOR

FIELD OF THE INVENTION

The present invention relates to a contact element for use in a unipolar or multipolar plug connector having a contact carrier made of an insulating material which includes at least a series of contact chambers into which at least one contact element can be inserted, the contact element showing a fastening section for the accommodation of an electrical line, a box-shaped contact section, as well as a snap-on lance which acts together directly or indirectly with the contact chamber in a latched manner.

BACKGROUND INFORMATION

Plugs for producing an electrical plug connection are known from the related art. They include essentially a plug-connector housing and a contact carrier accommodated by the plug-connector housing. The contact carrier has contact chambers that are able to be assembled with contact elements. In order to avoid an undesired removal of the contacts from the contact chambers, the contacts snap in in the contact chambers. This is done in many cases by having a projecting snap-on lance which is squeezed together when the contact element is introduced into the contact chamber, and, in the end position of the contact within the contact chamber, it snaps apart and latches in an undercut. The snap-on lance has a relatively narrow shape, as a rule, which is exposed from the contact element.

Similarly, an electrical contact element for accommodation in a contact chamber is also discussed in German patent document DE 36 00 456 A1. In this case, a region of the contact element has a snap-on arrangement that provides for latching the contact element within the contact chamber. When assembling a plug connection using contact elements, each respective snap-in arrangement is pressed together while the contact element is introduced into the contact chamber. First the contact element is plugged through a sealing mat that is usually provided in this context, before the contact element is completely pushed into the contact chamber and the desired end position is reached at which, either spring-supported or based on a sliding element, the snap-on springs open and snaps in in an undercut. The snap-on arrangement, developed as a snap-on lance, in this case has a relatively narrow, pointed shape which issues from the contact element.

In particular, contact elements having snap-on lances of the type of construction known from the related art have the disadvantage that these lances, because of their pointed shape, easily damage the sealing mat of a plug connector, that is usually made of rubber, when the plug connection is assembled, and particularly when the contact element is disassembled. This, in turn, leads to the plug connector not being executed fluid-tight, and thus the functioning of the plug connector is possibly impaired.

Furthermore, there is a disadvantage for the cable manufacturer in that, in a bundle of cables having attached contact elements, the contact elements easily hook together with their individual snap-on lances. This, in turn, leads to having to spend more time undoing the undesired connections between the individual contact elements.

Moreover, there is the danger that the snap-on lances will bend or break off while being untangled, so that latching within the contact chamber, which is actually desired, is no longer possible.

If so-called clean-body contact elements are used, according to the related art they have the disadvantage that they demonstrate very low latching forces within the contact chambers. Furthermore, based on relaxation of a snap-on lance made of plastic, the latching force decreases still further.

In addition, snap-on lances within the housing are usually difficult to design from a manufacturing technology point of view, and on the other hand, because of their inaccessibility in the plug-connector housing, it is very costly to submit them to a final inspection.

SUMMARY OF THE INVENTION

It is an object of the exemplary embodiments and/or exemplary methods of the present invention to avoid at least one of the above disadvantages of the contact elements thus developed.

An idea of the exemplary embodiments and/or exemplary methods of the present invention is that the latching of the contact element with the contact chamber, in the inserted state into the contact chamber, is produced by a part of the contact element, whereas in the not-yet-inserted state into the contact chamber the body of the contact element has a smooth outer geometry.

Attaining the object means that the snap-on lance essentially includes a top head element which is situated on the side of the contact element facing away from the contact chamber, and is slideable transversely to the plugging direction.

The exemplary embodiments and/or exemplary methods of the present invention has at least the advantage that it unites the properties, that are advantageous per se, of a locking mechanism having a snap-on lance (latching via a permanently elastic metal part at the contact element) with those of the clean-body construction (smooth outer geometry of the contact having no projecting parts).

In addition, it is advantageous that the contact elements designed according to the exemplary embodiments and/or exemplary methods of the present invention can be cut to length in a very simple manner, since it is avoided that they stick together mechanically, and thus the cable manufacturer can directly begin with the contacting, or rather the insertion of the contact elements into the contact chambers.

The specific embodiment advantageously may have a snap-on lance that is made of a permanently elastic metal part. It is developed so that it may form one piece with the rest of the contact element. It is avoided thereby that, particularly as is known from the related art, manifestations of fatigue or relaxation for plastic parts occur. In an example embodiment of the present invention, the contact element together with the snap-on lance is a punched bent part.

The snap-on lance for the contact element is developed in such a way that, in the inserted state within the contact chamber, the top element of the snap-on lance makes available a specified free space into which a secondary locking of the plug connector can be inserted. If the locking by the snap-on lance has not taken place within the contact chamber, this free space is not made available, and the secondary locking mechanism cannot be transferred to its locked position. This has the advantage that final checking can be conducted in a very simple way as to whether the latching, brought about by the snap-on lance, has been executed in a properly functioning manner.

The exemplary embodiments and/or exemplary methods of the present invention also has the advantage that the contact chamber should be designed in a simple way for the accommodation of the contact element according to the present invention. It has a rib within the contact chamber which is surrounded by a groove that is provided in the contact element. The rib extends over a part of the longitudinal extension of the contact chamber and forms a ramp on which the top element slides. The ramp is advantageously provided even before an undercut provided in the contact chamber. This has the effect that the top element, even before reaching this undercut, is pressed against the wall of the contact chamber in such a way that the side walls of the contact element advantageously bulge out, and this creates an elastic stress for the top element. Because of this elastic stress, the top element snaps into the undercut when it reaches it, and latches into it. Because of the rib lying opposite the undercut, the top element can no longer return to its original position.

Further advantageous embodiments will become apparent from the following descriptions, the claims and the drawings.

DETAILED DESCRIPTION

Figure 1:
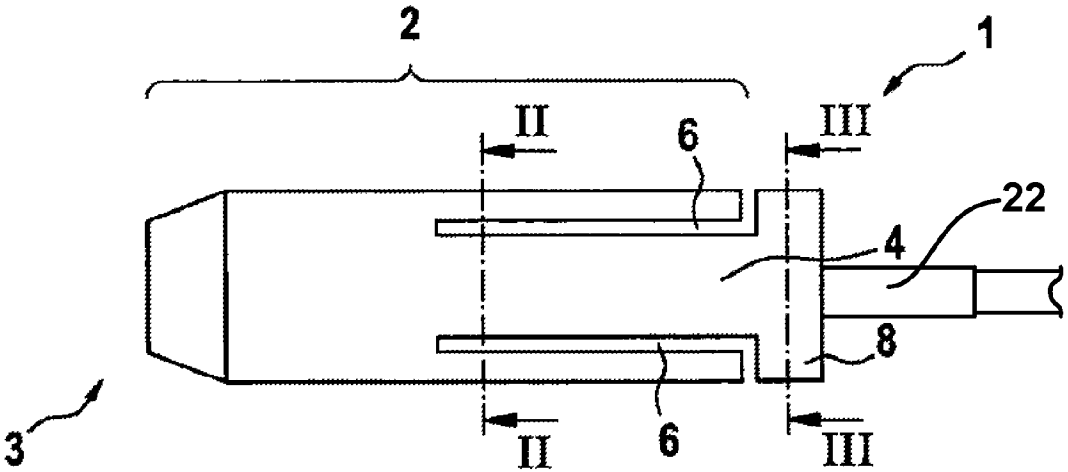
FIG. 1 shows a top view onto a schematically shown contact element having a snap-on lance.
Figure 2:
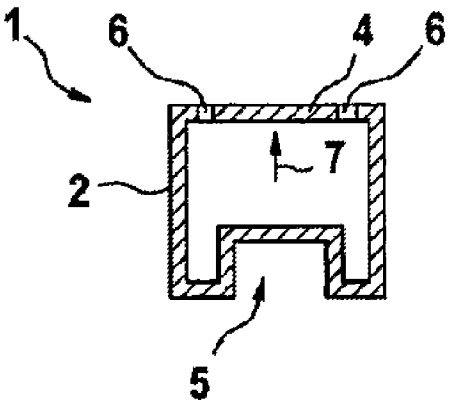
FIG. 2 shows a section through a contact element according to FIG. 1, along a line II-II.
Figure 3:
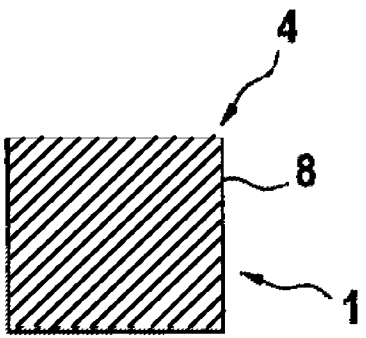
FIG. 3 shows a section through a contact element according to FIG. 1, along a line III-III.

A contact element 1 is schematically shown in FIG. 1. Contact element 1 is made up of a contact area 2 and a fastening area 22, an example of which is shown schematically in FIG. 1, to which an electric line can be attached. As shown in FIGS. 2 and 3, contact area 2 is designed to be box-shaped in cross section, and has an opening at its one end 3 which is used to accommodate a mating contact designed as a so-called blade (knife), in order to produce an electrical plug contact between a plug and a mating contact. For reasons of simplifying the representation, the inner region of the contact part in which the actual connection to the knife (blade) via, for example, contact laminations takes place, is not shown.

The illustration of the figures is limited exclusively to the points that are essential to the exemplary embodiments and/or exemplary methods of the present invention.

In addition, contact area 2 includes snap-on lance 4 that is connected to a body of the contact element 1 and is designed according to the exemplary embodiments and/or exemplary methods of the present invention. Contact area 2 further includes a groove 5 situated in contact area 2 (FIG. 2). Snap-on lance 4 is developed as a part of contact element 1, and is hinged to the body of contact element 1 in tongue-like fashion. Two slits 6 between the body and the snap-on lance 4 that run parallel to each other cause snap-on lance 4 to be movable at least in the direction of arrow 7, according to FIG. 2. In addition, snap-on lance 4 is connected to a top element 8, which is developed to be square in the exemplary embodiment shown here. It is provided, according to the exemplary embodiments and/or exemplary methods of the present invention, that top element 8 in its outer dimensions always corresponds to remaining contact area 2, so that no protruding elements interfere during the insertion of contact element 1 into a contact chamber. It is achieved thereby, according to the exemplary embodiments and/or exemplary methods of the present invention, that contact element 1, as it is shown in FIGS. 2 to 3, has a smooth outer contour when inserted into a contact chamber, although it includes a snap-on lance that collaborates with the contact chamber.

Figure 4:
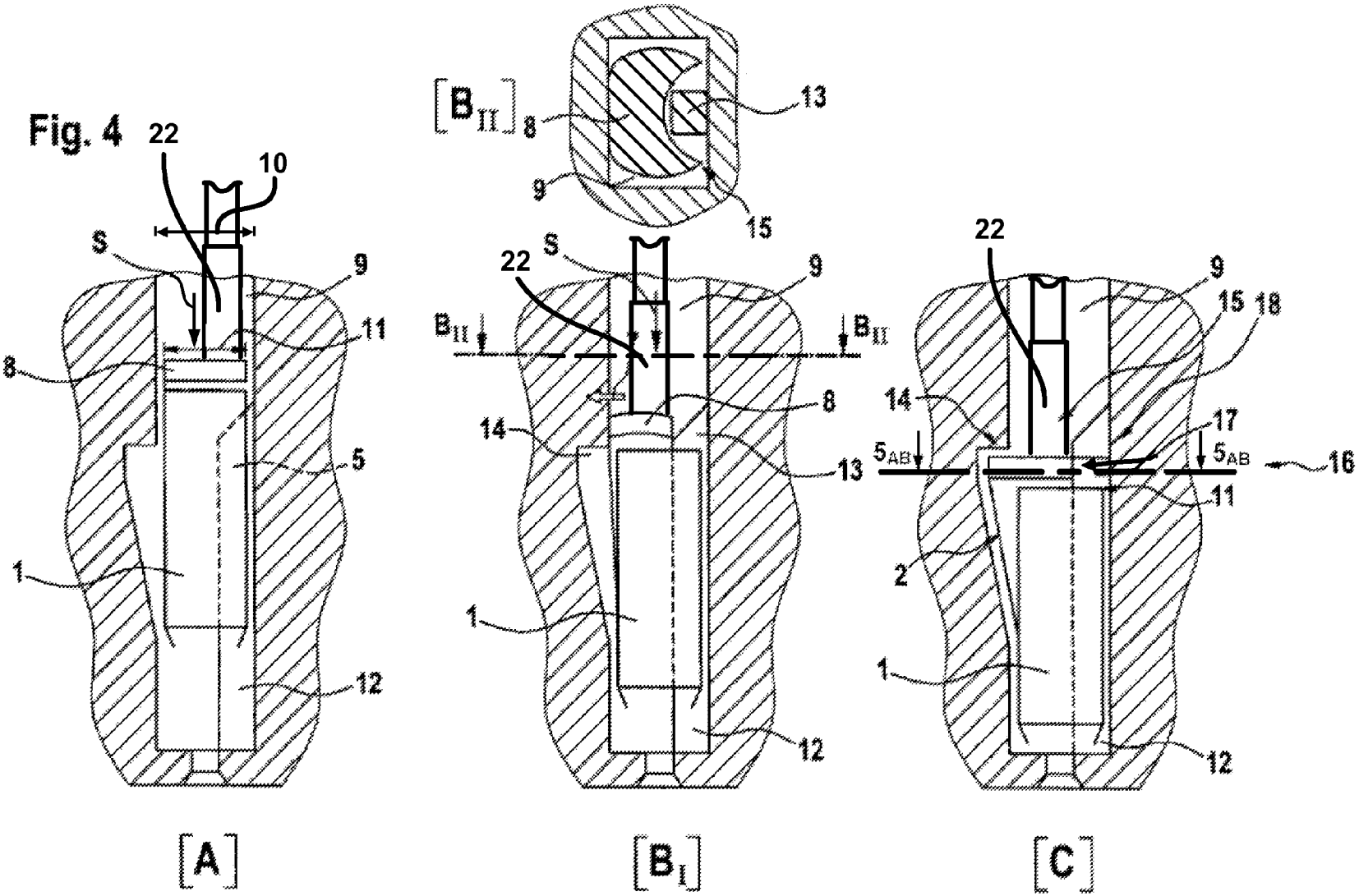
FIGS. 4A, 4B and 4C show a schematic illustration of the insertion of the contact element according to the present invention, according to FIG. 1, into a contact chamber, and the illustration of the latching within the contact chamber, in the individual steps.

In FIG. 4, the stepwise insertion of contact element 1 according to the exemplary embodiments and/or exemplary methods of the present invention, according to FIGS. 1 through 3, is shown in three illustrations (A, B and C).

Contact element 1 developed according to the exemplary embodiments and/or exemplary methods of the present invention, according to illustration A, in its so-called initial state, in which the outer contour of snap-on lance 4 locks with the outer contour of the remaining contact element 1, is inserted into a contact chamber 9 in the direction of arrow S. Contact chamber 9 is developed so as to have an inside diameter 10 which is slightly larger than width 11 of contact element 1 according to FIG. 1. Furthermore, contact chamber 9 has, at least in a partial region, a rib 12 which cooperates with groove 5 of contact element 1 in the state shown here, that is also shown in FIG. 2. Contact element 1 is inserted as far into contact chamber 9 in the direction of arrow S until top element 8 contacts rib 12 beginning in the direction of arrow S.

Since top element 8, as is also shown in FIG. 3, is developed over the whole surface and thereby covers remaining contact element 1, a ramp-like design 13 of rib 12 inside contact chamber 9 has the effect that top element 8 of snap-on lance 4 is moved in the direction of arrow 7 (shown in illustration $B_I$) while contact element 1 is guided further in the direction of arrow S.

Ramp-like design 13 may be situated within contact chamber 9 in such a way that the excursion of snap-on lance 4 already takes place at a time before snap-on lance 4 has reached a provided undercut 14 within contact chamber 9. This leads to increased latching security, it being necessary, however, that the excursion of snap-on lance 4 in the direction of arrow 7 takes place in such a way that, in particular in the transitional region, in which snap-on lance 4 is still sliding along on the inside wall of contact chamber 9 before penetrating undercut 14, a mechanical stress acts upon contact element 1. This becomes noticeable in that the mechanical stress is accommodated by the bulging out of the side walls of snap-on lance 4 (shown in illustration BII). In this case, it may advantageously also be meaningful to provide an appropriate lateral free space in region 15 according to FIG. 4. It should be ensured by the mechanical design of contact element 1 that the elastic energy, stored in the bulged out sidewalls, is greater than the deformation energy of snap-on lance 4, so that the latter will actually flip out as soon as there is the possibility for this, after passing undercut 14 (illustration C).

Figure 5:
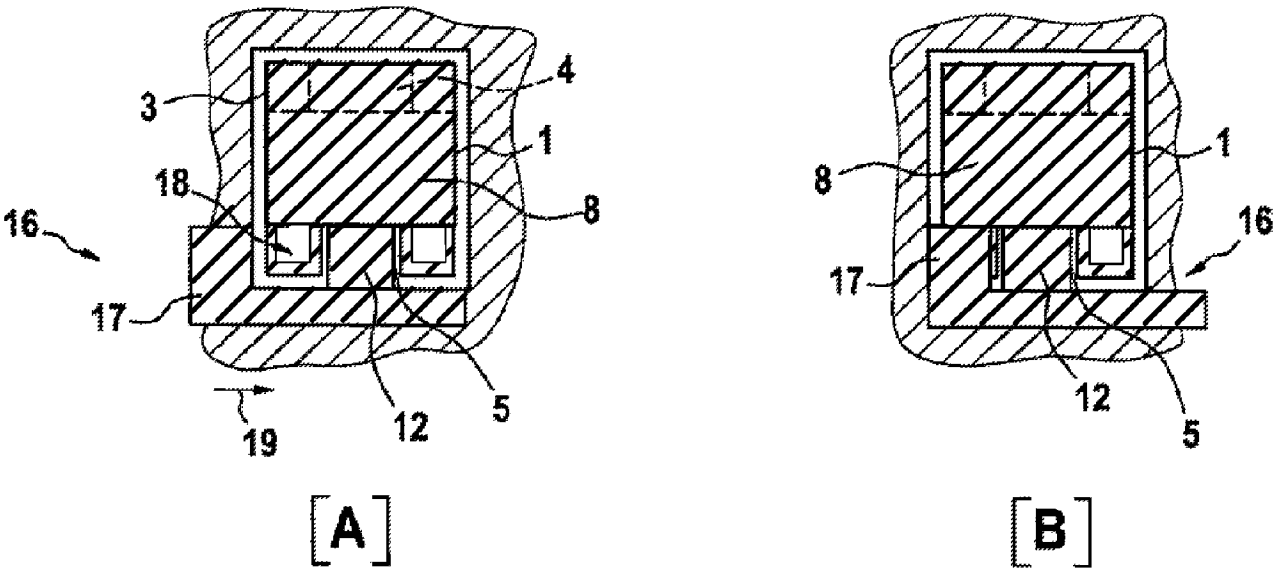
FIGS. 5A and 5B show a schematic illustration through a contact chamber having the inserted contact element according to FIG. 1, along a line $\mathbf{5}_{AB}$-$\mathbf{5}_{AB}$ having an opened and a closed secondary locking setting.

Moreover, in FIG. 4, illustration C as well as in FIG. 5, the use of a secondary locking mechanism 16 is shown, and the cooperation of secondary locking mechanism 16 with contact element 1 that is already situated in undercut 14. FIG. 5 (illustrations A and B) shows a top view onto top element 8, latched behind undercut 14 and secondary locking mechanism 16, in one case, in the open position (illustration A), and in the other case in a closed position (illustration B).

If secondary locking mechanism 16 according to FIG. 4, illustration C, and FIG. 5, illustration A, is carried out via a sliding plate 17, which is supported perpendicular to arrow direction S in a slideable manner, and if the secondary locking plane is put into the area of undercut 14 and snap-on lance 4, then, because of a region 18, which becomes free by sliding top element 8 of snap-on lance 4, the possibility arises of inserting sliding plate 17 at this location.

This brings the advantage that secondary locking mechanism 16, besides forming the locking, also forms control functions for the correct execution of the primary locking within contact chamber 9.

FIG. 5 shows the illustration of sliding plate 17 of secondary locking mechanism 16, and one can see that, by sliding sliding plate 17 in the direction of arrow 19, area 18 is correspondingly covered by sliding plate 17 and comes into contact with the surface of contact element 1, so that plugging forces acting through the mating plug do not lead to the shifting of contact element 1 within contact chamber 9.

Figure 6:
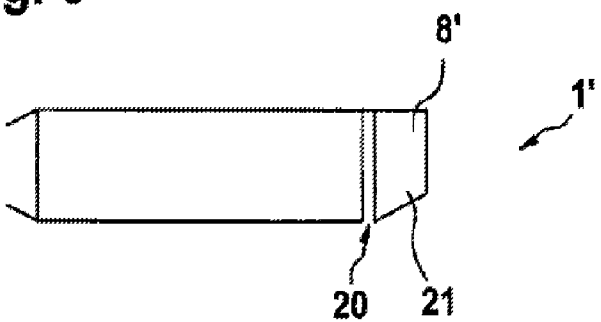
FIG. 6 shows a top view onto an alternative embodiment of a contact element according to the present invention.

If disassembly of contact element 1 is to be provided, FIG. 6 shows an alternative illustration of a contact element 1'. It differs from the exemplary embodiment shown in FIG. 1 in that top element 8' has a leading slant 21 which is supposed to produce an appropriate design for the disassembly. It is achieved hereby that the sealing mat, which is made of rubber, as a rule, is not damaged much, and it is also achieved that the sharp edges of the sheet metal bent part per se, as are formed, for instance, in area 20, are covered thereby.

In particular, because of the design of snap-on lance 4 as one piece that is connected to the remaining contact element 1, 1', it is achieved, by the cooperation with a rib 12 within contact chamber 9, that a non-resilient snap-on lance 4 should be developed for the primary locking of a contact element 1 within a contact chamber 9. In addition, the design according to the exemplary embodiments and/or exemplary methods of the present invention yields the possibility of providing a secondary locking mechanism 16, at the same time, which, besides locking, also forms control functions for the correct execution of the primary locking within contact chamber 9.

What is claimed is:

1. A contact arrangement, comprising:
- a contact carrier which includes at least a series of contact chambers; and
- at least one contact element insertable into the series of contact chambers;
- wherein each of at least one of the at least one contact element includes:
  - a fastening section for the accommodation of an electrical line;
  - a box-shaped contact section, that includes:
    - a body;
    - a snap-on lance connected to the body and which acts together with a respective one of the contact chambers in a latched manner; and
    - a top element connected to the snap-on lance and which:
      - in relation to a direction of insertion of the respective contact element into the respective contact chamber, is situated on a side of the respective contact element facing away from the respective contact chamber;
      - is, via engagement with a rib of the respective contact chamber, slideable transversely to the direction of insertion into the respective contact chamber so as to latch the respective contact element in the respective contact chamber via engagement with an undercut of the respective contact chamber; and
      - forms, with the snap-on lance and the body, a smooth outer geometry of the respective contact element before the insertion of the respective contact element into the respective contact chamber.

2. The contact arrangement of claim 1, wherein the snap-on lance and the respective contact element form a one-piece part.

3. The contact arrangement of claim 1, wherein the respective contact element together with the snap-on lance is a punched bent part.

4. The contact arrangement of claim 1, wherein the top element in a latched state cooperates with a secondary locking mechanism so that the secondary locking mechanism is transferable to its locking position exclusively in the latched state of the snap-on lance in an undercut of the respective contact chamber.

5. The contact arrangement of claim 1, wherein one of a unipolar and multipolar electrical plug includes the contact carrier.

6. The contact arrangement of claim 1, wherein the contact carrier is made of an insulating material.

7. The contact arrangement of claim 1, wherein the body of the respective contact element is shaped so as to form a groove in which the rib is relatively displaced during the insertion of the respective contact element in the respective contact chamber.

8. A contact arrangement, comprising:
- a contact carrier made of an insulating material, the contact carrier having at least a series of contact chambers;
- at least one contact element insertable into the series of contact chambers;
- wherein:
  - each of at least one of the series of contact chambers includes an undercut and at least one rib that cooperates with a groove of a respective one of the at least one contact element and that has a ramp-shape; and
  - the respective contact element includes:
    - a fastening section for the accommodation of an electrical line; and
    - a box-shaped contact section that includes:
      - a body that includes the groove;
      - a snap-on lance connected to the body and which acts together with the contact chamber in a latched manner; and
      - a top element connected to the snap-on lance and which:
        - in relation to a direction of insertion of the respective contact element into the contact chamber, is situated on a side of the respective contact element facing away from the contact chamber;
        - is, via engagement with the rib, slideable transversely to the direction of insertion into the contact chamber so as to latch the respective contact element in the contact chamber via engagement with the undercut; and
        - forms, with the snap-on lance and the body, a smooth outer geometry of the contact element before the insertion of the respective contact element into the contact chamber.

9. The contact arrangement of claim 8, wherein the ramp shape of the rib is situated at the height of the undercut, in a direction of insertion of the respective contact element into the contact chamber.

10. The contact arrangement of claim 8, wherein one of a unipolar and multipolar electrical plug includes the contact carrier.

11. A contact element, comprising:

a body;

a snap-on lance connected to the body; and a top element connected to the snap-on lance;

wherein:

a part of the body forms a groove; and the snap-on lance and the top element:

are adapted to be displaced relative to the body and into a latching position, by engagement of the top element with a rib of a contact chamber during insertion of the contact element into the contact chamber, transversely to a direction of the insertion; and form, before the insertion, a smooth outer geometry with an outline of the body, which outline is defined by outermost exterior edges of the body, one of the outermost exterior edges being divided by the groove.

12. The contact element of claim 11, wherein, in relation to the direction of the insertion, the top element is situated on a side of the contact element facing away from the contact chamber.

13. The contact element of claim 11, wherein the body includes a groove adapted for at least partially surrounding the rib when the contact element is inserted in the contact chamber.

14. The contact element of claim 11, wherein the contact element further comprises:

a fastening section for accommodation of an electrical line.

15. The contact element of claim 11, wherein the outer geometry formed by the snap-on lance and the top element with the body is box-shaped.

16. A contact chamber, comprising:

a rib having a ramp-shaped end formed on a first side;

an undercut formed on a second side opposite the first side;

wherein:

the contact chamber has an opening in which to receive a contact element;

the rib is positioned so as to (a) be at least partially surrounded by a body of the contact element when the contact element is inserted in the contact chamber, (b) cooperate with a groove formed by the body, and (c) engage a latching element of the contact element to move the latching element transverse to a direction of the insertion and toward the undercut; and the undercut is situated so as to engage the latching element of the contact element when the contact element is inserted in the contact chamber, the latching element being at a side of the contact element facing the opening.

17. The contact chamber of claim 16, wherein the undercut is in a plane that is, with respect to the opening, downstream of the ramp-shaped end.

18. A contact arrangement, comprising:

a contact chamber; and a contact element insertable into the contact chamber and that includes:

a body, wherein a part of the body forms a groove;

a snap-on lance connected to the body at a first end of the snap-on lance which acts together with the contact chamber in a latched manner; and a top element connected to the snap-on lance at a second end of the snap-on lance opposite the first end and which:

in relation to a direction of insertion of the contact element into the contact chamber, is situated on a side of the contact element facing away from the contact chamber;

is, via engagement with a rib of the contact chamber, slideable transversely to the direction of insertion into the contact chamber so as to latch the contact element in the contact chamber via engagement with an undercut of the respective contact chamber, the snap-on lance being moved relative to the body by the transverse sliding of the top element; and forms with the snap-on lance, before the insertion of the contact element into the contact chamber, a smooth outer geometry with an outline of the body, which outline is defined by outermost exterior edges of the body, one of the outermost exterior edges being divided by the groove.

* * * * *